US010815043B2

(12) United States Patent
Ito et al.

(10) Patent No.: US 10,815,043 B2
(45) Date of Patent: Oct. 27, 2020

(54) TAPE AND BAG BODY

(71) Applicant: IDEMITSU UNITECH CO., LTD., Tokyo (JP)

(72) Inventors: Shunichi Ito, Chiba (JP); Yoshinori Namba, Chiba (JP)

(73) Assignee: IDEMITSU UNITECH CO., LTD., Tokyo (JP)

( * ) Notice: Subject to any disclaimer, the term of this patent is extended or adjusted under 35 U.S.C. 154(b) by 0 days.

(21) Appl. No.: 16/322,192

(22) PCT Filed: Jul. 31, 2017

(86) PCT No.: PCT/JP2017/027623
§ 371 (c)(1),
(2) Date: Jan. 31, 2019

(87) PCT Pub. No.: WO2018/025792
PCT Pub. Date: Feb. 8, 2018

(65) Prior Publication Data

US 2019/0177067 A1 Jun. 13, 2019

(30) Foreign Application Priority Data

Aug. 1, 2016 (JP) ..... 2016-151469

(51) Int. Cl.
*B65D 75/66* (2006.01)
*B65D 33/00* (2006.01)
(Continued)

(52) U.S. Cl.
CPC ..... *B65D 75/66* (2013.01); *B65D 33/00* (2013.01); *B65D 33/14* (2013.01); *B65D 33/25* (2013.01);
(Continued)

(58) Field of Classification Search
CPC ..... B65D 75/66
(Continued)

(56) References Cited

U.S. PATENT DOCUMENTS 3,127,087 A * 3/1964 Spees ..... B65D 75/5805 383/205
3,266,965 A 8/1966 Spees
(Continued)

FOREIGN PATENT DOCUMENTS

CN 101014505 A 8/2007
CN 101072715 A 11/2007
(Continued)

OTHER PUBLICATIONS

Japanese Office Action dated May 29, 2018 issued in corresponding JP 2017-048950 application (10 pages).
(Continued)

*Primary Examiner* — Brent T O'Hern
(74) *Attorney, Agent, or Firm* — Millen, White, Zelano & Branigan, PC; Ryan Pool

(57) ABSTRACT

A tape bondable to an inner surface of at least one of films forming a bag body is provided. The tape includes: at least one elongated base; a tearing guide piece bonded to the base in a longitudinal direction of the base and capable of tearing the base and the film; and at least one protrusion protruding in a direction of the tearing guide piece from a surface of the base to which the tearing guide piece is bonded. The protrusion is formed on a portion of the base where the tearing guide piece is not bonded.

19 Claims, 10 Drawing Sheets

(51) Int. Cl.
*B65D 33/25* (2006.01)
*B65D 33/14* (2006.01)
*B65D 75/58* (2006.01)

(52) U.S. Cl.
CPC ..... *B65D 33/2508* (2013.01); *B65D 75/5827* (2013.01)

(58) Field of Classification Search
USPC ..... 428/172
See application file for complete search history.

(56) References Cited

U.S. PATENT DOCUMENTS

| | | | |
|---|---|---|---|
| 6,354,739 | B1 | 3/2002 | Sheehan, Jr. et al. |
| 2009/0190867 | A1 | 7/2009 | Goto et al. |
| 2009/0238500 | A1 | 9/2009 | Nanba et al. |
| 2010/0074562 | A1 | 3/2010 | Nanba et al. |
| 2010/0236026 | A1 | 9/2010 | Nanba et al. |
| 2010/0266224 | A1 | 10/2010 | Nanba et al. |
| 2012/0275730 | A1 | 11/2012 | Katada et al. |
| 2015/0183556 | A1 | 7/2015 | Shioda |

FOREIGN PATENT DOCUMENTS

| | | | | |
|---|---|---|---|---|
| CN | 101506052 | A | 8/2009 | |
| CN | 101522538 | A | 9/2009 | |
| CN | 102652097 | A | 8/2012 | |
| JP | 10-59384 | A | 3/1998 | |
| JP | 2003-522077 | A | 7/2003 | |
| JP | 2006-77085 | A | 3/2006 | |
| JP | 2008-221486 | A | 9/2008 | |
| JP | 5032945 | B2 | 9/2012 | |
| JP | 5651850 | B1 | 1/2015 | |
| JP | 2015-123987 | A | 7/2015 | |
| WO | 2006/062136 | A1 | 6/2006 | |
| WO | 2016/114303 | A1 | 7/2016 | |
| WO | WO-2016114303 | A1 * | 7/2016 | ..... A44B 19/16 |

OTHER PUBLICATIONS

Office Action issued in corresponding Chinese patent application No. 201780047586.9 dated Dec. 11, 2019 (pp. 1-8) and English translation (pp. 1-8).
International Search Report dated Oct. 24, 2017 issued in corresponding PCT/JP2017/027623 application (2 pages).
English Abstract of JP H 10-59384 A published Mar. 3, 1998.
English Abstract of JP 2006-077085 A published Mar. 23, 2006.
English Abstract of JP 2008-221486 A published Sep. 25, 2008.
English Abstract of JP 2015-123987 A published Jul. 6, 2015.
International Preliminary Report on Patentability dated Feb. 5, 2019 issued in corresponding PCT/JP2017/027623 application (8 pages).

* cited by examiner

TAPE AND BAG BODY

TECHNICAL FIELD

The present invention relates to a tape and a bag provided with the tape.

BACKGROUND ART

A typical bag for packaging various articles such as food, medicines, medical products and groceries is sealed at an upper side thereof. When opening the bag, films of the bag body are torn apart from a start position such as notches formed on both sides of the bag.

A cutting string has been used for linearly tearing the films of the bag body. However, it is difficult for a general bag-making machine to produce a bag provided with a cutting string. Moreover, since two films of the bag body at cut edges of the torn packaging bag are aligned, a finger cannot be inserted into between the films, so that it is difficult to pinch an opening of the packaging bag.

Accordingly, a typical bag includes: a bag body; and a cutting tape provided to the bag body, the cutting tape including a leading portion welded on an inner surface of the bag body and a base from which a part of the leading portion is exposed (Patent Literature 1).

Another typical bag provided with a cutting tape includes: a first strip-shaped base part including a male member and bonded to one surface of a bag body; a second strip-shaped base part including a female member and a convex portion, the female member being engageable with the male member, the convex portion being bonded to the one surface of the bag body; and a cutting tape provided to an end of the first strip-shaped base part near the convex portion with respect to the male member (Patent Literature 2).

CITATION LIST

Patent Literatures

Patent Literature 1 JP Patent No. 5032945
Patent Literature 2 JP Patent No. 5651850

SUMMARY OF THE INVENTION

Problems to be Solved by the Invention

In the typical bag of Patent Literature 1, since the leading portion is exposed at a part of the base, the exposed portion defines an opening of the packaging bag. Since a finger easily catches the base, the packaging bag can be easily opened, which shows an excellent easy-openability. Moreover, since the finger can be easily inserted into the opening, the opening can be easily widened, so that contents can be easily taken out of the packaging bag.

Patent Literature 2 discloses a zipper tape including the base part having the male member and the base part having the female member. Accordingly, when contents are taken out of the bag after the bag is opened by pulling the cutting tape, at an opening of the bag defined by the cutting tape, an engagement portion of the male member and the female member and the longer one of the base parts may block passage of a finger and the contents.

An object of the invention is to provide a tape and a bag easily openable and allowing contents to be easily taken out after the bag is opened.

Means for Solving the Problems

According to an aspect of the invention, a tape bondable to an inner surface of at least one of films forming a bag body is provided. The tape includes: at least one elongated base; a tearing guide piece bonded to the base in a longitudinal direction of the base and configured to tear the base and the at least one film; and at least one protrusion protruding in a direction of the tearing guide piece from a surface of the base on which the tearing guide piece is bonded.

In the arrangement of the tape attached to the inner surface of the at least one of the films forming the bag body, when the tearing guide piece is pulled in a direction of the base in order to open the bag body, the tearing guide piece tears the film of the bag body while tearing the base, thereby forming an opening. In other words, after the base has been torn by the tearing guide piece, the opening is formed along the tearing guide piece on the bag body. Accordingly, it can be expected that no cutting tool (e.g., scissors) is required for opening the bag.

Since the tearing guide piece defines the opening along the width of the tearing guide piece, there is no obstacle to a hand insertion into the opening at an unbonded portion of the base to the tearing guide piece. Consequently, it becomes easy to insert a hand into the opening in order to take out the contents from the bag body.

Since the protrusion is provided to the base in the tape of the above arrangement, it can be expected to adjust a direction in which the film of the bag body is torn to a specific direction.

In the tape of the above arrangement, the protrusion has any shape of not blocking the passage of a hand and the contents through the opening when the contents are taken out. For instance, the protrusion may have a shape protruding in a direction perpendicular to the base from a surface of the base to which the tearing guide piece is bonded, whereby it can be expected that the protrusion does not block the passage of a finger and the contents through the opening.

Herein, the tearing guide piece is a member bonded to the inner surface of at least one of the films forming the bag body and configured to guide tearing of the film(s) of the bag body along a position of the tearing guide piece bonded to the film(s) of the bag body, thereby guiding the opening process of the bag body.

A material of the tearing guide piece preferably has a higher rigidity than that of a material of the base. The rigidity herein referred can be measured with reference to a tensile modulus of each of the materials. The tensile modulus can be measured with a testing machine in conformity to JIS B7721, ISO9513 and 5.1.2 to 5.1.6 using, as test pieces, the tearing guide piece and the base obtained by cutting a tape.

When the material of the tearing guide piece is firmly bonded to the material of the base, the position of the tearing guide piece bonded to the film of the bag body is fixed. Accordingly, a position of the opening formed by the tearing guide piece on the bag body is not irregular. Examples of a method of improving a bonding strength between the material of the tearing guide piece and the material of the base include: using a combination of highly compatible resins for the material of the tearing guide piece and the material of the base; and providing a layer (e.g., an adhesion layer), which is formed of a material highly compatible with the material of the tearing guide piece and the material of the to-be-torn base for opening, between the tearing guide piece and the base.

The tape of the above arrangement is suitably usable for any bag capable of containing the contents therein. Examples of the bag for which the tape of the above arrangement is suitably usable include a bag having a gusset at the bottom thereof, a bag having a so-called standing bottom with a gusset, a bag having no gusset at sides thereof, and a so-called gusset bag having a gusset at sides thereof.

Further, the base of the tape of the above arrangement may be in a form of a single member or may be divided into a plurality of members as long as the base is bondable to the inner surface of at least one of the films of the bag body. The base in a form of a plurality of members may have a space(s) between the plurality of members.

The tape of the above arrangement is integrally formable by extruding the resin forming the members of the tape.

The tape of the above arrangement may further include at least one elongated block disposed across the tearing guide piece from the base, the at least one elongated block being bondable to the tearing guide piece, wherein the base and the block are provided along a longitudinal direction of the tearing guide piece with the tearing guide piece interposed therebetween.

In the above arrangement, even when a resin of the tearing guide piece is poorly compatible with a resin of surfaces of the films forming the bag body, it can be expected to avoid occurrence of pinholes between the film and the tearing guide piece at the bonding of the tape to the bag body to improve sealability of the bag before being opened, since the base is present between the tearing guide piece and the film forming one of the inner surfaces of the bag body and the block is present between the tearing guide piece and the film forming the other of the inner surfaces of the bag body.

The block may be in a form of a single member or a plurality of members as long as the block is bondable to the tearing guide piece. Further, the block may have the same shape as that of the base.

Alternatively, the block and the base may be an integrated member or separate members.

By bonding the block to an entire widthwise surface of the tearing guide piece along a longitudinal direction of the tearing guide piece, occurrence of pinholes between the film and the tearing guide piece can be more effectively avoided.

The block and the tearing guide piece are integrally formable by extruding the resin forming the block and the tearing guide piece. Since the extrusion is applicable to the integral formation of the block and the tearing guide piece, occurrence of pinholes between the block and the tearing guide piece can also be effectively inhibited.

The tape of the above arrangement may further include at least one convex portion protruding in a direction of the tearing guide piece from a surface of the block on which the tearing guide piece is bonded. The at least one protrusion is formed on a part of the base to which the tearing guide piece is not bonded.

In the above arrangement, even when the tearing direction of the base and the film of the bag body using the tearing guide piece is deviated, the position of the tearing guide piece is restricted by the convex portion, so that it is expected to adjust the tearing direction of the base and the film of the bag body.

Herein, the convex portion has any specific shape capable of adjusting the tearing direction of the film of the bag body to a correct direction.

In the tape of the above arrangement, the convex portion and the protrusion may be disposed with the tearing guide piece interposed therebetween, and an end of the convex portion in the protruding direction is bondable to the film of the bag body to which the base is bondable. At this time, the block is bondable through the convex portion to the inner surface of the at least one film of the bag body.

In the above arrangement, the base and the block are disposed in a first direction with the tearing guide piece interposed therebetween, and the convex portion and the protrusion are disposed in a second direction intersecting the first direction with the tearing guide piece interposed therebetween. Accordingly, the tape can be made compact.

In the tape of the above arrangement, a bonding strength between the base and the tearing guide piece may be larger than a bonding strength between the block and the tearing guide piece.

In the above arrangement, since the bonding strength between the base and the tearing guide piece is large and the bonding strength between the block and the tearing guide piece is small, the tearing guide piece is firmly bonded to the base when being pulled toward the base. Since the base having a strong bonding strength is bonded to the inner surface of the film of the bag body, the tape is prevented from being irregularly positioned when the tearing guide piece tears the bag body. On the other hand, by setting the bonding strength between the base and the tearing guide piece at the strength at which the base and the tearing guide piece can be easily separated from each other, it is expected that the tearing guide piece can easily and reliably tear the bag body and the base.

A method of adjusting the bonding strength between the material of the tearing guide piece and the material of the base is not limited to a particular one. Examples of the method include a method of adjusting the bonding strength by combining resins having different compatibility and a method of adjusting the bonding strength by providing a layer (an adhesion layer) for increasing the bonding strength between the base and the tearing guide piece. The method of combining resins having different compatibility is exemplified by a method of forming the block and the tearing guide piece using mutually poorly compatible resins while forming the base and the tearing guide piece using mutually well-compatible resins. A method of using the same resin for the base and the block is exemplified by a method of using mutually poorly compatible resins for the tearing guide piece and the block and interposing an adhesion layer between the mutually poorly compatible base and the tearing guide piece. Thus, even when the base and the block are formed of the same resin, the tape can be easily manufactured by extrusion.

For instance, the adhesion layer is preferably metallocene LL having a high bonding strength to both of the polyethylene (PE) and polypropylene (PP).

In the tape of the above arrangement, the block and the tearing guide piece may be formed of mutually poorly compatible resins while the base and the tearing guide piece may be formed of mutually well-compatible resins.

In the above arrangement, since the block and the tearing guide piece are formed of the mutually poorly compatible resins, the bonding strength between the block and the tearing guide piece is small. Since the base to be torn by the tearing guide piece and the tearing guide piece are formed of mutually well-compatible resins, the bonding strength between the base and the tearing guide piece is large.

The tearing guide piece is firmly bonded to the base when being pulled toward the base. Since the base having a strong bonding strength is bonded to the inner surface of the bag, the tape is prevented from being irregularly positioned when the tearing guide piece tears the bag body. By setting the bonding strength between the base and the tearing guide piece at the strength at which the base and the tearing guide piece can be easily separated from each other, it is expected that the tearing guide piece can easily and reliably tear the bag body and the base.

In the tape of the above arrangement, the protrusion may be in no contact with the tearing guide piece.

In the above arrangement, since the protrusion is in no contact with the tearing guide piece, a space is formed between the protrusion and the tearing guide piece, whereby the protrusion and the tearing guide piece can be prevented from being integrated when manufacturing the tape by extrusion. Further, even when the melt resin spreads sideways during the bonding of the tape to the inner surface of the film of the bag body, it is expected that presence of the space prevents fusion of the resin of the tearing guide piece and the resin of the base and stabilizes the tearing direction in which the tearing guide piece tears the base.

In the tape of the above arrangement, a portion of the base corresponding to a space between the protrusion and the tearing guide piece may be thinned.

In the above arrangement, when the tearing guide piece is pulled, the thinned portion of the base is torn. Accordingly, only a small force is required for tearing the base.

According to another aspect of the invention, a bag including a bag body made of films, and a tape bonded to an inner surface of at least one of the films of the bag body is provided. The tape includes: at least one elongated base; a tearing guide piece bonded to the base in a longitudinal direction of the base and configured to tear the base and the at least one film; and at least one protrusion protruding in a direction of the tearing guide piece from a surface of the base on which the tearing guide piece is bonded. The tape is bonded to the inner surface of the at least one film of the bag body through the at least one base.

When the tearing guide piece is pulled toward the base in order to open the above bag, the tearing guide piece tears the film together with the base. After the base and the film have been torn by the tearing guide piece, the opening is formed along the tearing guide piece on the base and the film. Since no obstacle to insertion of a hand is present at the opening, it is expected that it becomes easy to insert a hand through the opening to the innermost part of the bag body and the contents are easily taken out of the bag body. Moreover, since the protrusion is provided to the base, the direction in which the film of the bag body is torn is adjusted to a specific direction, thereby preventing variation in size of the openings among the bag bodies.

The bag in the above arrangement may further include at least one elongated block disposed across the tearing guide piece from the base, the at least one elongated block bonded to the tearing guide piece, wherein the base and the block are provided along a longitudinal direction of the tearing guide piece with the tearing guide piece interposed therebetween.

In the above arrangement, since the base and the block are disposed with the tearing guide piece interposed therebetween, the film of the bag body is not directly bonded to the tearing guide piece. Accordingly, even when the tearing guide piece and the film are formed of the mutually poorly compatible materials, occurrence of pinholes on the bag body when manufacturing the bag is prevented.

The bag of the above arrangement may further include at least one convex portion protruding in a direction of the tearing guide piece from a surface of the block on which the tearing guide piece is bonded. The at least one protrusion is formed on a part of the base to which the tearing guide piece is not bonded.

In the above arrangement, the tearing direction is expected to be adjusted by the convex portion when the tearing guide piece tears the base and the film of the bag body.

In the bag of the above arrangement, the convex portion and the protrusion may be disposed with the tearing guide piece interposed therebetween, and an end of the convex portion in the protruding direction is bondable to the film of the bag body to which the base is bondable.

In the above arrangement, since the base and the block are disposed in a first direction with the tearing guide piece interposed therebetween and the convex portion and the protrusion are disposed in a second direction intersecting the first direction, a portion of the bag where the tape is provided can be made compact. Since the convex portion provided to the block is bonded to the film of the bag body, after the bag is opened, the block and the convex portion are not separated from the film to which the base of the bag body is bonded. Accordingly, the block and the convex portion are less likely to be obstacles when a user puts his hand into the opening in order to take out the contents from the bag.

In the bag of the above arrangement, a bonding strength between the base and the tearing guide piece may be larger than a bonding strength between the block and the tearing guide piece.

In the above arrangement, the tearing guide piece is firmly bonded to the base when being pulled toward the base. Accordingly, the base and the film are not irregularly torn by the tearing guide piece. In addition, since the tearing guide piece is easily peeled off from the block, it is expected that the tearing guide piece can easily and reliably tear the base and the film.

In the bag of the above arrangement, the block and the tearing guide piece may be formed of mutually poorly compatible resins while the base and the tearing guide piece may be formed of mutually well-compatible resins.

In the above arrangement, when the tearing guide piece is pulled toward the base formed of the resin well-compatible with the tearing guide piece, interfacial peeling occurs between the tearing guide piece and the block formed of the resin poorly compatible with the tearing guide piece to be easily peeled off from the block. Accordingly, when tearing film of the bag body, breakage of the tearing guide piece caused by material breakage can be avoided. Further, generation of cut-piece remains on peeling surfaces of the respective tearing guide piece and block can be avoided.

Further, since the tearing guide piece and the block of the tape manufactured by extrusion are integrated, a feeling of resistance to tearing of the film of the bag body is constant, so that the opening of the bag is expected to be repeatedly formed in a certain shape.

In the bag of the above arrangement, the protrusion may be in no contact with the tearing guide piece.

In the above arrangement, since the protrusion is in no contact with the tearing guide piece, it is expected that the tearing direction in which the tearing guide piece tears the base and the film is stabilized. Accordingly, it is expected that the opening is neatly formed on the bag body.

In the bag of the above arrangement, a portion of the base corresponding to a space between the protrusion and the tearing guide piece may thinned.

In the above arrangement, when the tearing guide piece is pulled, the thinned portion of the base and the corresponding portion of the film of the bag body are torn. Accordingly, it can be expected that only a small force is required for tearing the bag.

In the bag of the above arrangement, the bag body may have first and second walls facing each other, the first wall may be configured to define an opening by being torn by the tearing guide piece, and a part of the tearing guide piece on the second wall may be exposed outside through a hole or a weakened line.

In the above arrangement, when the end of the tearing guide piece is pulled toward the base, the first wall of the bag body is torn together with the base by the tearing guide piece to form the opening. At this time, although resistance occurs on the second wall of the bag body since a portion of the second wall corresponding to the end of the tearing guide piece is torn together with the tearing guide piece, the second wall is broken due to the presence of the hole or the weakened line. Accordingly, since it is not necessary to tear away the second wall in order to tear the base and the film by the tearing guide piece, the bag can be opened only by a small force.

Herein, examples of the weakened line include a portion thinner than the other portions, a gap, perforations (holes in a dotted line), and a portion formed of a softer and more easily cuttable material than the other portions. The weakened line has a rigidity weakened enough for the film to be torn at the weakened line.

A shape of the hole is not necessarily circular but may be elliptical, rectangular, triangular and the like.

In the bag of the above arrangement, the bag body may form a receiving portion capable of receiving contents therein, and the bag body may have a contents-receiving opening defined by edges thereof opposite from a portion where the receiving portion is formed, with respect to the tape.

In the above arrangement, the bag is provided with the tape bonded only to at least one inner surface of the bag body. Accordingly, it is not necessary to disengage the tape and open the bag in order to put the contents into the bag, and the contents can be easily put through a contents-receiving opening formed on edges of the bag body. After the contents are received in the bag, the contents-receiving opening is bonded.

In the bag of the above arrangement, the bag body may form a receiving portion capable of receiving contents therein, and the bag body may have a contents-receiving opening defined by edges thereof opposite from a portion where the receiving portion is formed, with respect to the tape.

In the above arrangement, the contents can be prevented from leaking from the edges of the bag.

In the bag of the above arrangement, the bag body may be provided with a holding portion at an end thereof.

In the above arrangement, the bag is easily holdable with use of the holding portion.

A form of the holding portion is not limited to a particular one. Examples of the holding portion include a grip defined by a single hole provided to an upper end of the bag body, a grip defined by a cord put through the upper end of the bag body, and a holding portion formed by bonding a grip member made of a resin, a metal or the like to the upper end of the bag body.

In the bag of the above arrangement, the bag body may include: a pair of flat portions facing each other; a pair of lateral portions interposed between the pair of flat portions at both side edges of the bag body; and a bottom portion, the lateral portions and the bottom portion being inwardly folded along folding lines.

In the above arrangement, by unfolding the folded lateral portions and bottom portion, a large receiving portion can be formed, whereby a larger amount of the contents can be received in the bag.

DESCRIPTION OF EMBODIMENT(S)

Figure 1:
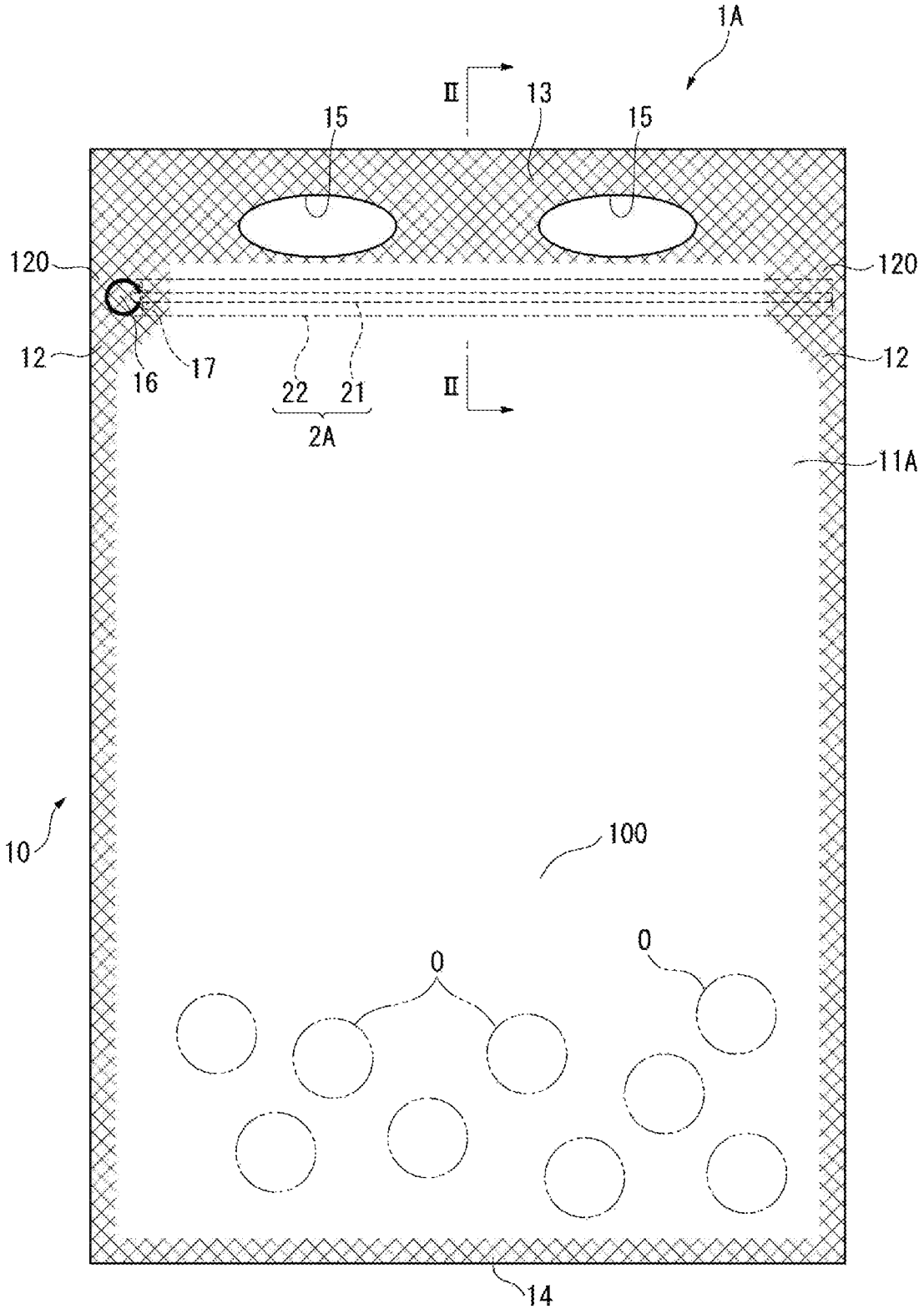
FIG. 1 is a front elevational view of a bag in a first exemplary embodiment of the invention.

Exemplary embodiments of the invention will be described with reference to the attached drawings. In the description of the exemplary embodiments, common reference numerals will be given to the same components to omit their explanations.

First Exemplary Embodiment

A first exemplary embodiment of the invention will be described with reference to FIGS. 1 to 5.

Overall Structure of Bag Body

FIG. 1 illustrates an overall structure of a bag body provided with a tape in the first exemplary embodiment.

As shown in FIG. 1, a bag 1A includes a bag body 10 that is formed by layering films 11A and 11B on each other (note that only the film 11A is shown in FIG. 1) and forming side seal portions 12, a top seal portion 13 and a bottom seal portion 14 on a periphery of the layered films.

A tape 2A configured to tear a wall of the film 11A is attached to an inner surface of the film 11A with a predetermined distance from the top seal portion 13.

A space across the tape 2A of the bag body 10 from the top seal portion 13 is defined as a receiving portion 100 configured to receive contents O therein.

Structure of Tape

Figure 2:
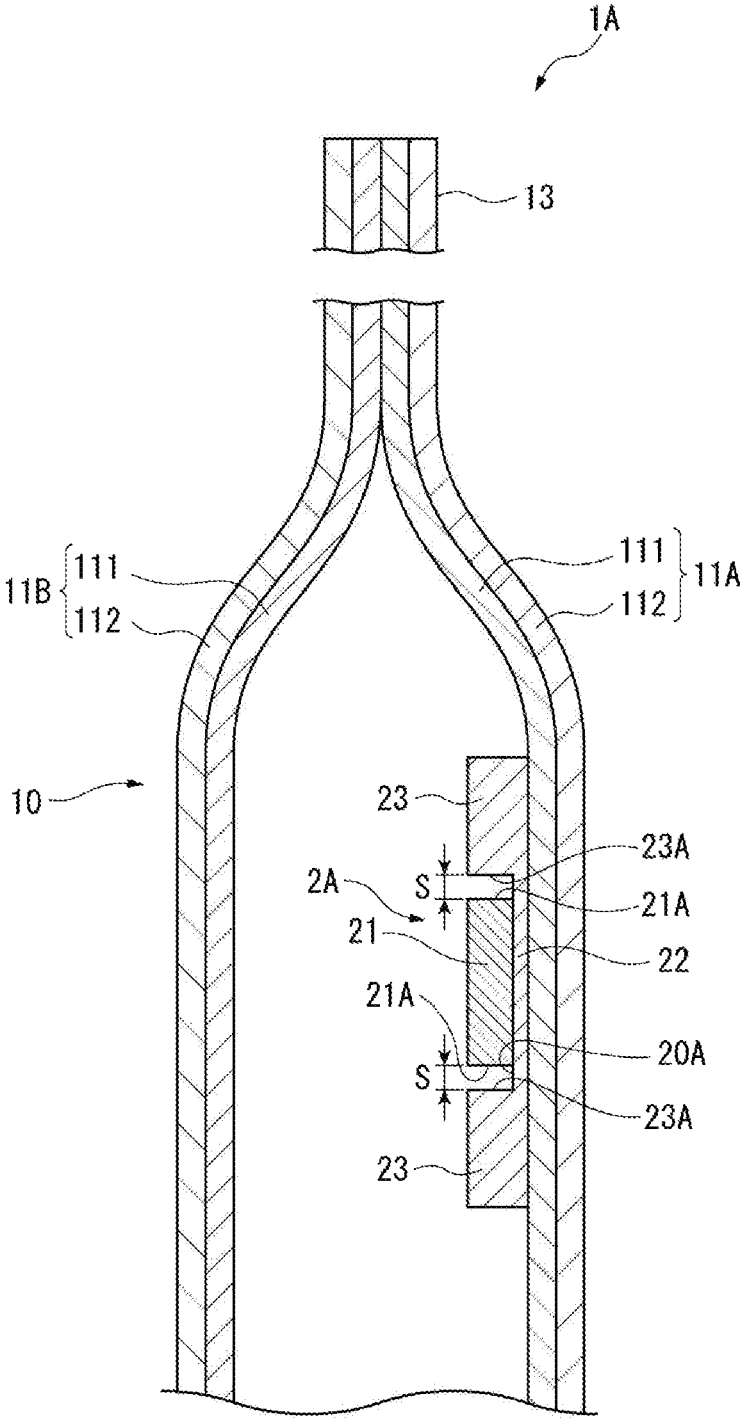
FIG. 2 is a cross sectional view taken along II-II line and viewed in a direction of an arrow in FIG. 1.

As shown in FIGS. 1 and 2, the tape 2A includes a tearing guide piece 21, a base 22 bonded to the film 11A, and a protrusion 23 integrated with the base 22.

The base 22 is an elongated member extending along the top seal portion 13 and has a rectangular cross section in a plane orthogonal to a longitudinal direction of the base 22. Herein, a direction along a surface of the base 22 bonded to the film 11A in the plane orthogonal to the longitudinal direction of the base 22 (i.e., a top-bottom direction in FIG. 2) is defined as a width direction.

The tearing guide piece 21 is a member for guiding a tearing position of the base 22 and the film 11A when the base 22 and the film 11A are torn to open the bag. A cross section of the tearing guide piece 21 in a plane orthogonal to a longitudinal direction of the tearing guide piece 21 is, for instance, rectangular as shown in FIG. 1. However, the tearing guide piece 21 may have any cross section such as triangular and semicircular ones. Alternatively, the tearing guide piece 21 may be in a form of a cord.

The tearing guide piece 21 is bonded to a widthwise middle of a surface of the base 22 opposite from the surface thereof bonded to the film 11A.

The protrusions 23, which are unbonded portions of the base 22 to the tearing guide piece 21, protrude in a direction perpendicular to the base 22 from a surface 20A of the base 22 to which the tearing guide piece 21 is bonded.

The protrusions 23 are respectively provided to widthwise sides (top and bottom sides in FIG. 2) of the base 22 while the tearing guide piece 21 is interposed between the protrusions 23.

A cross section of each of the protrusions 23 in a plane orthogonal to the longitudinal direction of the base 22 is, for instance, rectangular as shown in FIG. 2. However, the protrusions 23 may have any cross section such as triangular and semicircular ones.

A surface of the tearing guide piece 21 and a surface of each of the protrusions 23 which are opposite from the base 22 are parallel to the surface 20A and are unbonded to an inner surface of the film 11B except for bonding portions 120 shown in FIG. 1.

The base 22 and one of the protrusions 23 share a side surface (an upper surface in FIG. 2) facing the top seal portion 13. The base 22 and the other of the protrusions 23 share a side surface (a lower surface in FIG. 2) opposite from the side surface facing the top seal portion 13.

A surface 21A of the tearing guide piece 21 faces a surface 23A of each of the protrusions 23 in no contact with each other. In other words, a space S is defined between the surface 21A of the tearing guide piece 21 facing each of the protrusions 23 and the surface 23A of each of the protrusions 23 facing the tearing guide piece 21.

The base 22 and the protrusions 23 are integrally formed of the same material.

A material of the tearing guide piece 21 preferably has a higher rigidity than that of the material of the base 22. The rigidity referred herein can be measured with reference to a tensile modulus of each of the materials. The tensile modulus can be measured with a testing machine in conformity to JIS B7721, ISO9513 and 5.1.2 to 5.1.6 using, as test pieces, the tearing guide piece 21 and the base 22 obtained by cutting a tape.

The material of the tearing guide piece 21 is preferably firmly bonded to the material of the base 22 in order to prevent positional variation of the later-described openings 10S among a plurality of bags 1A. Examples of a method of improving a bonding strength between the material of the tearing guide piece 21 and the material of the base 22 include: using highly compatible resins in combination; and providing a layer formed of a highly compatible material (e.g., an adhesion layer) (not shown) between the tearing guide piece 21 and the base 22.

The combination of the highly compatible resins is not limited to, but exemplified by a suitable combination of resin compositions each having a main component that is at least two resins selected from low-density polyethylene (LDPE), linear low-density polyethylene, metallocene linear low-density polyethylene, ethylene-vinyl acetate copolymer (EVA), and ethylene-methacrylic acid copolymer (EMAA). In addition, the combination of the highly compatible resins is exemplified by a suitable combination of resin compositions each having a main component that is at least two resins selected from random PP, block PP, homo PP, and metallocene linear low-density polyethylene.

When the base 22 and the protrusions 23 are formed of a polyethylene resin and the tearing guide piece 21 is formed of a polypropylene resin, an adhesion layer may be provided between the base 22 and the tearing guide piece 21, the adhesion layer being metallocene linear low-density polyethylene, a blend of PE and PP, or the like.

Referring back to FIG. 1, two grips 15 (a holding portion) each defined by a hole are provided in the top seal portion 13.

The grips 15 are defined by oval holes formed on the films 11A and 11B. It should be noted that a shape of each of the holes is not necessarily oval but may be circular, rectangular, triangular and the like. The number of the holes defining the grips 15 may be at least one, which is determined as desired, in order to suitably hold the bag.

The side seal portions 12 include the respective bonding portions 120 that are longitudinal ends of the tape 2A. One of the bonding portions 120 (on the left in FIG. 1) is provided with an unsealing tab 16 and a weakened line 17, which serves as an easy opening structure, adjacent to the unsealing tab 16 in a direction where the bag body 10 is torn from the unsealing tab 16 to be opened.

Structure of Film

As shown in FIG. 2, each of the films 11A and 11B includes: a sealant layer 111 forming an inner surface of the bag body 10; and a base layer 112 forming an outer surface of the bag body 10.

Each of the films 11A and 11B is preferably a laminate film in which the sealant layer 111 is laminated on the base layer 112. An intermediate layer (not shown) such as a gas barrier layer, a light-blocking layer, and a reinforced layer may be laminated into between the base layer 112 and the sealant layer 111, depending on the required performance.

For the base layer 112, a biaxially oriented polypropylene (OPP) film, a biaxially oriented polyester film such as a biaxially oriented polyethylene terephthalate (OPET) film and a biaxially oriented polyethylene naphthalate (OPEN) film, or a biaxially oriented polyamide film such as nylon 6, nylon 66 and polymethaxylyleneadipamide (MXD6) may be suitably used. Various engineering plastic films are usable as needed. One of the above may be used alone, or a plurality of the above may be combined into a laminate.

When the intermediate layer is a gas barrier layer, films such as saponified ethylene-vinyl acetate copolymer (EVOH), polyvinylidene chloride (PVDC) and polyacrylonitrile (PAN), an aluminum foil, a vapor-deposited layer of a substance such as silica, alumina and aluminum, or a coating layer of PVDC can be used for the intermediate layer.

For the sealant layer 111 (the innermost layer), low-density polyethylene, linear low-density polyethylene or polypropylene (CPP) can be used.

Structure of Unsealing Tab

Figure 3A:
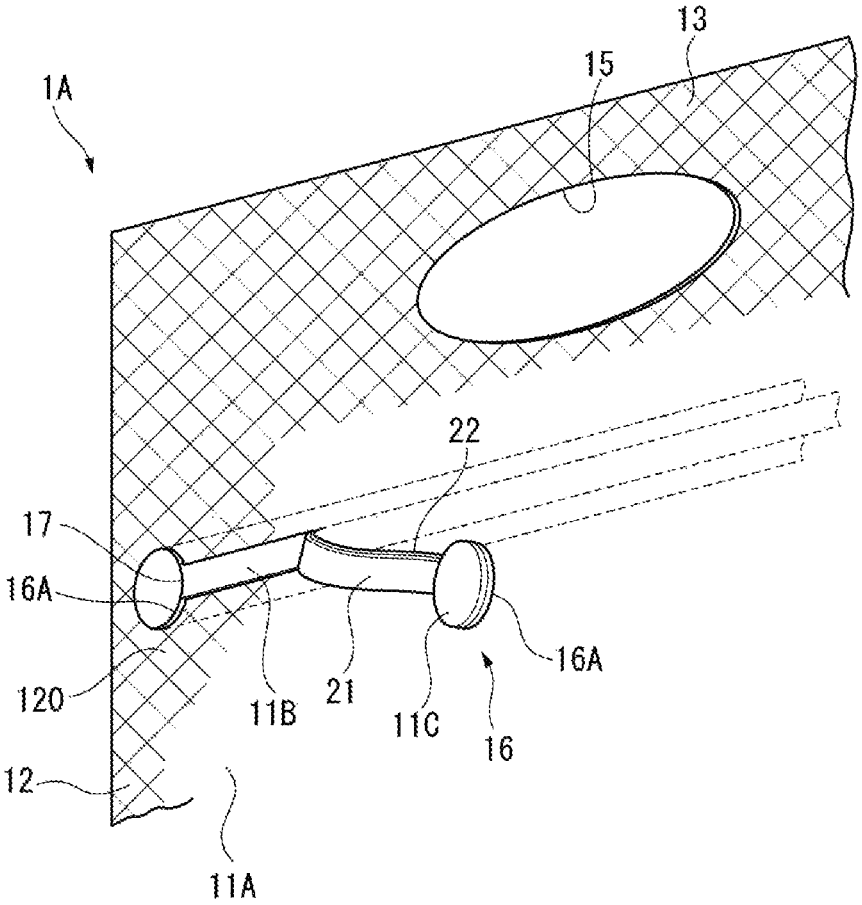
FIG. 3A is a perspective view showing a part of the bag.
Figure 3B:
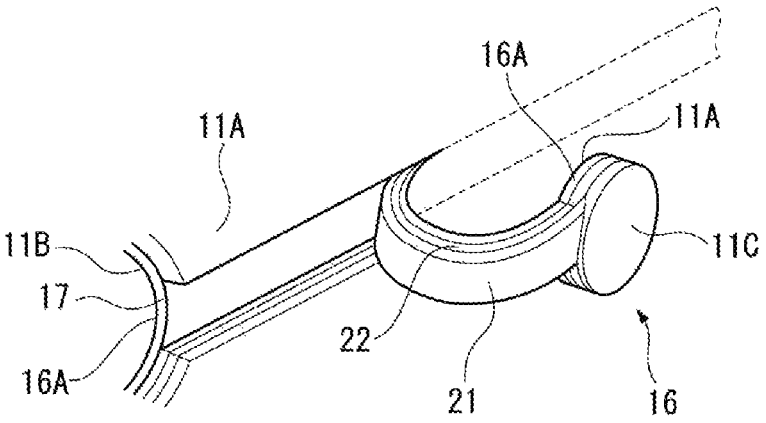
FIG. 3B is a perspective view showing a relevant part of an unsealing tab.

FIG. 3A shows a part of the bag 1A. FIG. 3B shows a relevant part of the unsealing tab 16.

As shown in FIGS. 3A and 3B, the unsealing tab 16 includes: a part of the tearing guide piece 21; and a portion obtained by cutting the base 22, the protrusions 23 and the films 11A and 11B along a cut portion 16A.

The cut portion 16A has any shape capable of delimiting a periphery of the unsealing tab 16. Specifically, the cut portion 16A may be in any shape such as a semicircular shape as well as C-shape as shown in FIGS. 1, 3A and 3B.

In the formation of the unsealing tab 16, the bonding portion 120 is cut so as to penetrate the mutually overlaid films 11A and 11B, thereby forming the cut portion 16A, and simultaneously only a wall of the film 11B is cut. The portion at which only the film 11B is cut is the above-described weakened line 17. A part of the tearing guide piece 21 is exposed outside through the weakened line 17.

An end of the tearing guide piece 21 is pulled toward the base 22 with unsealing tab 16 being pinched, so that the film 11A is linearly torn by the tearing guide piece 21.

The weakened line 17 is formed on the film 11B. Accordingly, when the base 22 and the film 11A are torn by the tearing guide piece 21, the film 11B is broken at the weakened line 17 and a remaining portion 11C of the broken film 11B adheres to the unsealing tab 16.

Manufacturing Method of Bag

In a manufacturing method of the bag 1A in the exemplary embodiment, the tape 2A having the above structure is manufactured by extrusion. Specifically, for instance, the tape 2A can be obtained such that the base 22 and the protrusions 23 are integrated with the tearing guide piece 21 by co-extrusion.

Subsequently, the films 11A, 11B and the tape 2A are used to manufacture the bag 1A with a widely used three-side seal bag-making machine (not shown) and the like.

The three-side seal bag-making machine positions the tape 2A fed from a tape feeder between a pair of films 11A and 11B and bonds the tape 2A to the film 11A. Then, while delivering the films 11A and 11B, the three-side seal bag-making machine fuses the films 11A and 11B at a predetermined interval in the delivery direction to form the side seal portions 12 and the bottom seal portion 14. Further, the three-side seal bag-making machine forms the unsealing tab 16 at the bonding portion 120.

Figure 4:
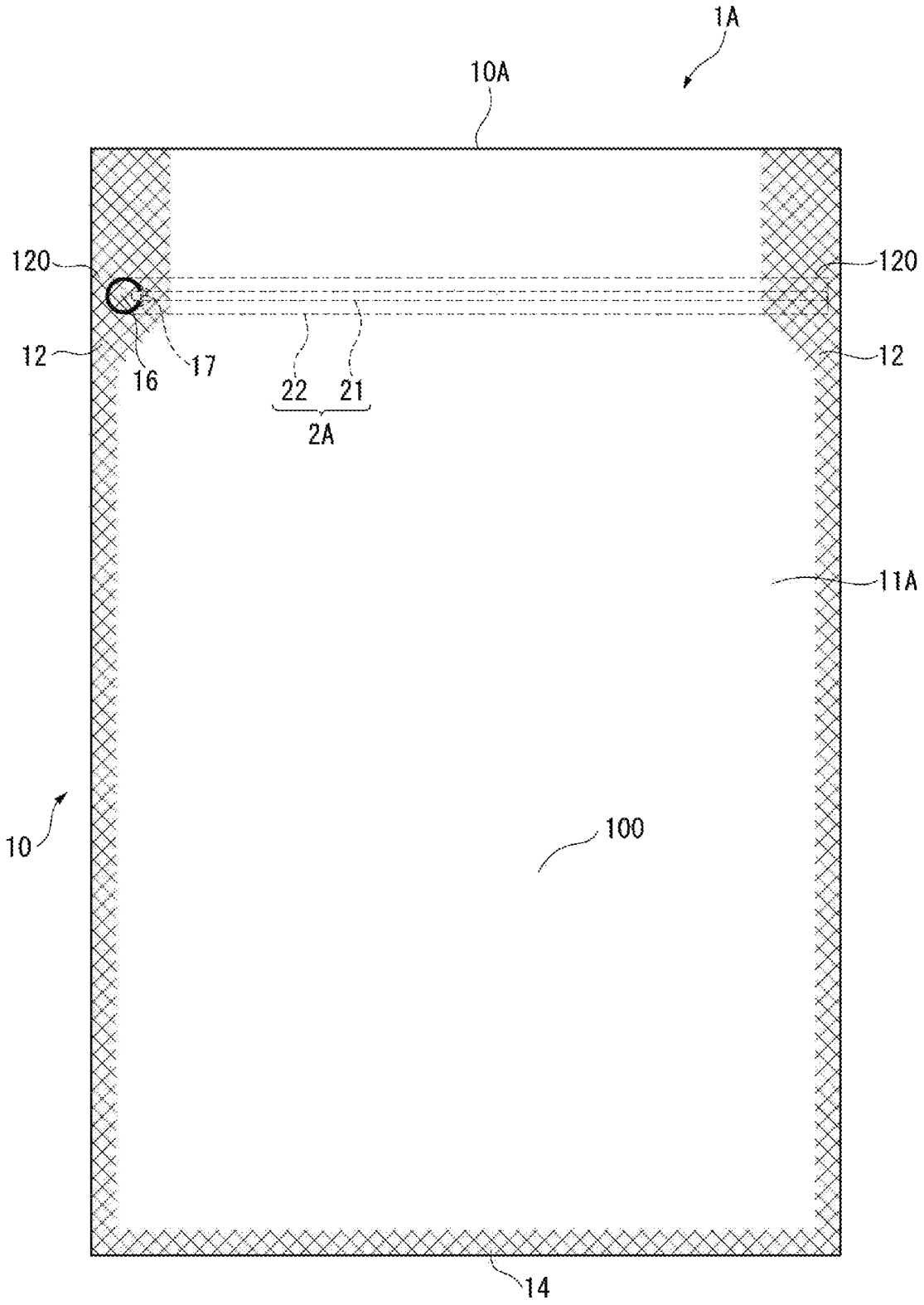
FIG. 4 is a front elevational view of the bag before receiving contents.

FIG. 4 shows the bag 1A in this state.

In the state shown in FIG. 4, no top seal portion 13 and no grip 15 is formed on the bag body 10 of the bag 1A. A contents-receiving opening 10A is formed at edges of the bag body 10 opposite from a portion where the receiving portion 100 is formed, with respect to the tape 2A. An area of the tape 2A stretching between the bonding portions 120 on both ends of the tape 2A is not bonded to the film 11B (see FIG. 5A). Accordingly, by widening a gap between the film 11A and the film 11B, a large space can be formed between the tape 2A and the film 11B.

After the contents O are put into the receiving portion 100 from the contents-receiving opening 10A through the space between the tape 2A and the film 11B, the contents-receiving opening 10A of the bag body 10 is sealed to form the top seal portion 13, and further the grip 15 is formed. By this operation, the bag 1A containing the contents O is manufactured (see FIG. 1).

Bag Opening Method

Next, a method of opening the bag 1A in the exemplary embodiment will be explained with reference to FIG. 5.

Figure 5A:
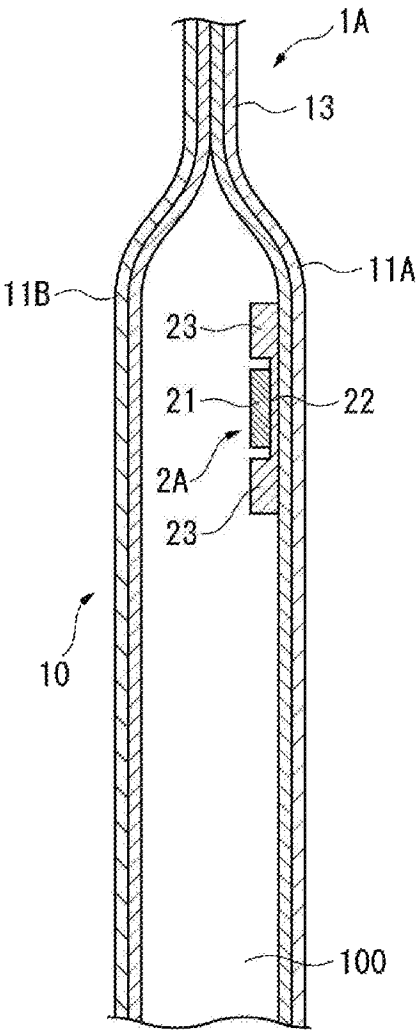
FIG. 5A illustrates an opening procedure of the bag.

Firstly, FIG. 5A shows a state of the bag 1A in an unopened state. In this state, the base 22 of the tape 2A is bonded to the film 11A among the films 11A and 11B forming the bag body 10.

Figure 5B:
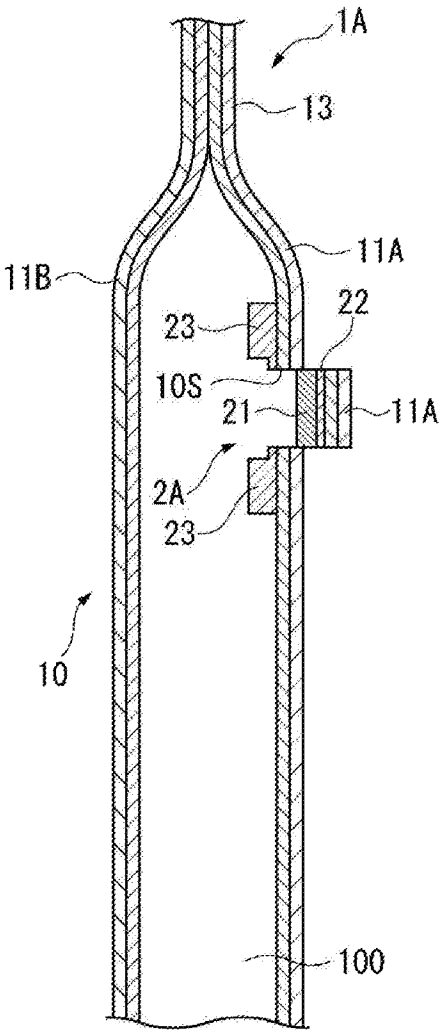
FIG. 5B illustrates the opening procedure of the bag.
Figure 5C:
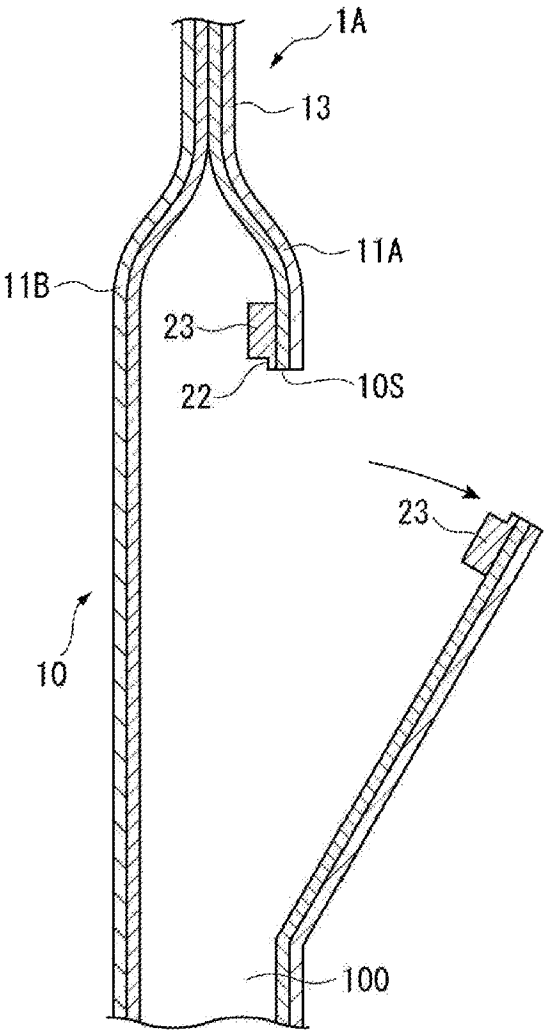
FIG. 5C illustrates the opening procedure of the bag.

In order to open the bag 1A, the unsealing tab 16 shown in FIGS. 1, 3A and 3B is pulled. In response, as shown in FIG. 5B, the tearing guide piece 21 tears the base 22 and the film 11A. At this time, although the film 11B generates resistance when being torn at a portion of the film 11B corresponding to the end of the tearing guide piece 21 together with the tearing guide piece 21, the film 11B is broken along the weakened line 17.

The base 22 and the film 11A after being torn by the tearing guide piece 21 define the opening 10S of the bag 1A along the tearing guide piece 21.

The opening 10S is formed along a longitudinal direction of the tape 2A. The opening 10S can be widened by hooking a finger (not shown) at a portion of the opening 10S formed at or near the middle of the base 22 (see FIG. 5C). When a user inserts his hand into the opening 10S in this state, since no obstacle to disturb the user when he takes out the contents O shown in FIG. 1 is found around the opening 10S, the user can reach his hand to the innermost of the receiving portion 100 containing the contents O.

Advantages of First Exemplary Embodiment

The first exemplary embodiment can produce advantages exemplified as follows.

(1) The tape 2A includes the base 22 bonded to the film 11A forming the bag 1A, the tearing guide piece 21 bonded to the base 22 and configured to tear the base 22 and the film 11A, and the protrusions 23 that are the unbonded portions of the base 22 to the tearing guide piece 21 and protrude from the surface of the base 22 to which the tearing guide piece 21 is bonded. After the base 22 and the film 11A have been torn by the tearing guide piece 21, the opening 10S is formed along the tearing guide piece 21 on the base 22 and the film 11A, so that the contents O can be easily taken out through the opening 10S. In addition, since the protrusions 23 are provided along the tearing guide piece 21 to the base 22, the direction in which the film 11A is torn is adjusted to a particular direction, so that occurrence of variation in size of the opening 10S among a plurality of bags 1A can be prevented. Further, the tearing guide piece 21, the base 22 the protrusions 23 are integrally formed by extruding the resin for forming the tape 2A.

(2) The protrusions 23 are in no contact with the tearing guide piece 21 and the spaces S are formed therebetween. According, in the manufacturing of the tape 2A, when the tape 2A is bonded to the inner surface of the film 11A of the bag body 10, the resin of the tearing guide piece 21 can be prevented from fusing the resin of the base 22. Consequently, it is expected that the tearing direction in which the tearing guide piece 21 tears the base 22 is stabilized.

(3) The bag 1A in the exemplary embodiment includes: the bag body 10 made of the films 11A and 11B; and the tape 2A attached to the film 11A.

This arrangement can provide the bag 1A that is easily openable and from which the contents O are easily taken out after the bag 1A is opened.

(4) The opening 10S is formed by tearing the film 11A using the tearing guide piece 21. On the film 11B, a part of the tearing guide piece 21 is exposed outside through the weakened line 17. Accordingly, when the film 11A is torn with the tearing guide piece 21 to open the bag, although the film 11B generates resistance when being torn together with the tearing guide piece 21, the film 11B is broken along the weakened line 17. Accordingly, the bag can be opened by a small force without tearing the film 11B apart.

(5) The receiving portion 100 configured to receive the contents O is formed in the bag body 10. In the manufacturing of the bag body 10, the contents-receiving opening 10A is formed at the edges of the bag body 10 opposite from the portion where the receiving portion 100 is formed, with respect to the tape 2A. In this state, the contents O can be easily put into the receiving portion 100 through the contents-receiving opening 10A.

(6) After the bag body 10 has been manufactured, the edges of the bag body 10 opposite from the portion where the receiving portion 100 is formed with respect to the tape 2A are bonded at the top seal portion 13. In this state, the contents O can be prevented from leaking from the edges of the bag 1A.

(7) Since the grip 15 is provided at the end of the bag body 10, the bag body 10 can be easily held.

(8) The protrusions 23 are respectively provided to the widthwise sides of the base 22 while the tearing guide piece 21 is interposed between the protrusions 23. Accordingly, when the tearing guide piece 21 tears the base 22 and the film 11A, the tearing direction can be more accurately adjusted by the protrusions 23 provided on both the sides of the tearing guide piece 21.

Second Exemplary Embodiment

Figure 6:
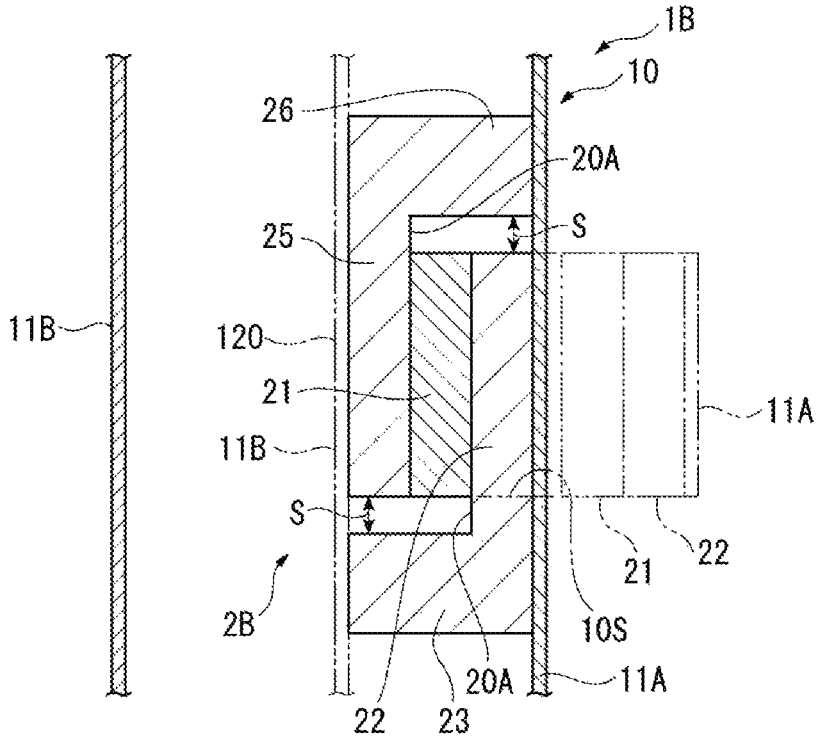
FIG. 6 is a cross sectional view of a relevant part of a bag in a second exemplary embodiment of the invention.

A second exemplary embodiment of the invention will be described with reference to FIG. 6. FIG. 6 is an enlarged cross section corresponding to FIG. 2 in the first exemplary embodiment. In FIG. 6, the top seal portion 13 is on the top and the bottom seal portion 14 is on the bottom (see FIGS. 1 and 2).

In the second exemplary embodiment described below, a tape 2B includes a block 25 in a form of a separate member from the base 22. The second exemplary embodiment is the same as the first exemplary embodiment except for the tape 2B different from the tape 2A of the first exemplary embodiment.

It should be noted that the films 11 and 11B are the same as those in the first exemplary embodiment although the films 11 and 11B in FIG. 6 are illustrated thinner than those in FIG. 2 in thickness.

In FIG. 6, a bag 1B of the second exemplary embodiment includes: the films 11A and 11B forming the bag body 10; and the tape 2B.

Structure of Tape

The tape 2B includes: the tearing guide piece 21; the base 22 and the protrusion 23; the elongated block 25 in a form of a separate member from the base 22; and a convex portion 26 integrally formed with the block 25.

The base 22 and the block 25 are provided along the longitudinal direction of the tearing guide piece 21 with the tearing guide piece 21 interposed therebetween.

The base 22 is provided to the film 11A that is to be torn by the tearing guide piece 21 when opening the bag body 10. The block 25 is provided to the film 11B that is not to be torn by the tearing guide piece 21 when opening the bag body 10.

As exemplarily shown in FIG. 6, the cross-sectional shape of the block 25 and the convex portion 26 is the same as that of the base 22 and the protrusion 23. The block 25 and the convex portion 26 are disposed relative to the base 22 and the protrusion 23 so as to be symmetric with respect to the center of a cross section of the tearing guide piece 21.

An opposite surface of the base 22 from the surface to which the tearing guide piece 21 is bonded is bonded to the film 11A. An end surface of the protrusion 23 faces the film 11B.

An opposite surface of the block 25 from the surface to which the tearing guide piece 21 is bonded faces the film 11B.

The convex portion 26 protrudes in a direction perpendicular to the block 25 from a surface 20A continuous to a surface of the block 25 to which the tearing guide piece 21 is bonded.

A cross-sectional shape of the convex portion 26 is rectangular in the same manner as the protrusion 23. An end surface of the convex portion 26 is bonded to the film 11A. It should be noted that, in the same manner as the protrusion 23, the cross-sectional shape of the convex portion 26 is not necessarily rectangular, but may be triangular, semicircular or the like.

The space S is defined between the base 22, the tearing guide piece 21 and the convex portion 26. Similarly, the space S is defined between the block 25, the tearing guide piece 21 and the protrusion 23. Accordingly, the tearing guide piece 21 is exposed to the receiving portion 100 (see FIG. 1).

In FIG. 6, a position of the film 11B at each of the bonding portions 120 (see FIG. 1) is shown by a chain double-dashed line and a position of the film 11B between the bonding portions 120 is shown by a solid line. The block 25 and the protrusion 23 are bonded to the film 11B at the bonding portions 120 while the block 25 and the protrusion 23 are spaced from the film 11B at a position except for the bonding portions 120.

In the second exemplary embodiment, the bonding strength between the base 22 and the tearing guide piece 21 is larger than a bonding strength between the block 25 and the tearing guide piece 21. Specifically, for instance, the block 25 and the tearing guide piece 21 are formed of mutually poorly compatible resins while the base 22 and the tearing guide piece 21 are formed of mutually well-compatible resins. Alternatively, the block 25 and the convex portion 26 may be formed of a resin poorly compatible with a resin for forming the tearing guide piece 21 while the base 22 and the protrusion 23 may be formed of a resin poorly compatible with a resin for forming the tearing guide piece 21, and an adhesion layer (not shown) for increasing the bonding strength between the base 22 and the tearing guide piece 21 may be provided between the base 22 and the tearing guide piece 21.

Herein, the mutually poorly compatible resins are preferably a combination of a low-density polyethylene resin and a random polypropylene resin. Specifically, examples of the combination of the mutually poorly compatible resins include low-density polyethylene (LDPE)/random polypropylene (RPP), linear low-density polyethylene (LLDPE)/RPP (partially including m-LL), LDPE/homopolypropylene (HPP), LLDPE/HPP (partially including m-LL), LDPE/polystyrene (PS), LLDPE/PS (including m-LL), RPP/PS, HPP/PS, LDPE/polyethylene terephthalate (PET), LLDPE/PET, RPP/PET, HPP/PET, PS/PET, LDPE/nylon (Ny), LLDPE/Ny, RPP/Ny, HPP/Ny, and PS/Ny.

For instance, the base 22 and the protrusion 23 are formed of metallocene linear low-density polyethylene, the tearing guide piece 21 is formed of a random polypropylene resin, and the block 25 and the convex portion 26 are formed of low-density polyethylene (LDPE). When the material of the base 22 and the protrusion 23 is the same as the material of the block 25 and the convex portion 26, the adhesion layer may be provided between the tearing guide piece 21 and the base 22 in order that the bonding strength between the tearing guide piece 21 and the base 22 is larger than than the bonding strength between the tearing guide piece 21 and the block 25.

The bonding strength between the base 22 and the tearing guide piece 21, which is weaker, is at a level enough to allow the base 22 and the tearing guide piece 21 to be easily separated from each other. Accordingly, it is expected that the tearing guide piece 21 can easily and reliably tear the base 22 and the film 11A. A material of the adhesion layer in the second exemplary embodiment may be the same as the material of the adhesion layer in the first exemplary embodiment.

Manufacturing Method of Bag

A manufacturing method of the bag 1B in the second exemplary embodiment is basically the same as that in the first exemplary embodiment.

Firstly, the tape 2B is manufactured by extrusion. Specifically, for instance, the tape 2B can be obtained such that the base 22 and the protrusion 23, the block 25 and the convex portion 26, and the tearing guide piece 21 are integrated with each other by co-extrusion. In this operation, by the extrusion, one of the flat surfaces of the tearing guide piece 21 is bonded to the flat surface of the base 22 while the other of the flat surfaces of the tearing guide piece 21 is bonded to the flat surface of the block 25. When the base 22 and the protrusion 23 are extruded with the same compatible resin as that of the block 25 and the convex portion 26, the adhesion layer is provided between the tearing guide piece 21 and the base 22.

The tape 2B is positioned between a pair of films 11A and 11B and is bonded to the film 11A. Then, the films 11A and 11B are fused to form the side seal portions 12 and the bottom seal portion 14 and subsequently the unsealing tab 16 is formed. Here, for the formation of the side seal portions 12, ends of the tape 2B are held between the film 11A and the film 11B and thermally bonded thereto.

Bag Opening Method

In order to open the bag, the tearing guide piece 21 tears the base 22 and the film 11A (see chain double-dashed line in FIG. 6). The base 22 and the film 11A after being torn by the tearing guide piece 21 define the opening 10S of the bag 1B along the tearing guide piece 21. The block 25 and the convex portion 26 are left bonded to the film 11A.

Advantages of Second Exemplary Embodiment

The second exemplary embodiment can produce the following advantages in addition to the same advantages as the advantages (1) to (7) of the first exemplary embodiment.

(9) The base 22 and the block 25 are provided along the longitudinal direction of the tearing guide piece 21 while the tearing guide piece 21 is interposed therebetween. With this arrangement, the block 25 is interposed between the tearing guide piece 21 and the film 11B. Accordingly, even when a resin poorly compatible with the films 11A and 11B, particularly the film 11B not to be torn by the tearing guide piece 21, is used as the resin of the tearing guide piece 21, occurrence of pinholes between the films 11A, 11B and the tearing guide piece 21 at the formation of the side seal portions 12 can be avoided to improve sealability of the unopened bag 1B. Further, by manufacturing the tape 2B by extruding the resin, occurrence of pinholes between the block 25 and the tearing guide piece 21 can be also effectively inhibited. Moreover, by bonding the block 25 to an entire widthwise surface of the tearing guide piece 21 along the longitudinal direction of the tearing guide piece 21, occurrence of pinholes between the film 11B and the tearing guide piece 21 can be more effectively avoided.

(10) Since the block 25 is provided with the convex portion 26, even when the tearing direction in which the tearing guide piece 21 tears the base 22 and the film 11A is deviated, the tearing guide piece 21 is positionally restricted by the convex portion 26, so that the tearing direction of the base 22 and the film 11A can be adjusted. Further, the tape 2B can be made compact since the base 22 and the block 25 are disposed in a first direction with the tearing guide piece 21 interposed therebetween, and the convex portion 26 and the protrusion 23 are disposed in a second direction orthogonal to the first direction with the tearing guide piece 21 interposed therebetween.

(11) Since the convex portion 26 is bonded to a part of the film 11A between the bonding portions 120, the block 25 and the convex portion 26 are kept bonded to the film 11A even after the bag is opened. Accordingly, the block 25 and the convex portion 26 are less likely to be obstacles when a user puts his hand into the opening 10S in order to take out the contents from the bag 1B. If the convex portion 26 is not bonded to the part of the film 11A between the bonding portions 120 on both the ends of the tape 2B, a belt-shaped member made of the block 25 and the convex portion 26 is separated from the film 11A, resulting in an obstacle when the user puts his hand into the opening 10S.

(12) Since the bonding strength between the base 22 and the tearing guide piece 21 is larger than the bonding strength between the block 25 and the tearing guide piece 21, the tearing guide piece 21 is reliably bonded to the base 22. Accordingly, the tearing guide piece 21 is not irregularly positioned, so that the tearing guide piece 21 can be expected to be easily peeled off from the block 25. Accordingly, the base 22 and the film 11A can be easily torn with the tearing guide piece 21.

(13) When the block 25 and the tearing guide piece 21 are formed of the mutually poorly compatible resins, interfacial peeling occurs between the block 25 and the tearing guide piece 21. The tearing guide piece 21 is easily peeled off from the the block 25 due to the interfacial peeling. Moreover, when tearing the film 11A of the bag body 10, breakage of the tearing guide piece 21 caused by material breakage can be avoided. Further, generation of cut-piece remains on peeling surfaces of the respective tearing guide piece 21 and block 25 can be avoided. In addition, when the base 22 and the tearing guide piece 21 are formed of the mutually well-compatible resins, the base 22 and the tearing guide piece 21 can be firmly bonded to each other, so that a positional variation of the opening 10S among a plurality of bags 1B is expected to be decreased.

(14) When the block 25 and the tearing guide piece 21 are formed of the mutually poorly compatible resins, the base 22 and the tearing guide piece 21 are formed of the mutually poorly compatible resins, and the adhesion layer for reinforcing the bonding strength between the base 22 and the tearing guide piece 21 is provided between the base 22 and the tearing guide piece 21, the material of the base 22 can be the same as the material of the block 25. In this arrangement, management of the resins (material) is easy, so that a manufacturing cost of the tape 2B is expected to be reduced.

Third Exemplary Embodiment

Figure 7:
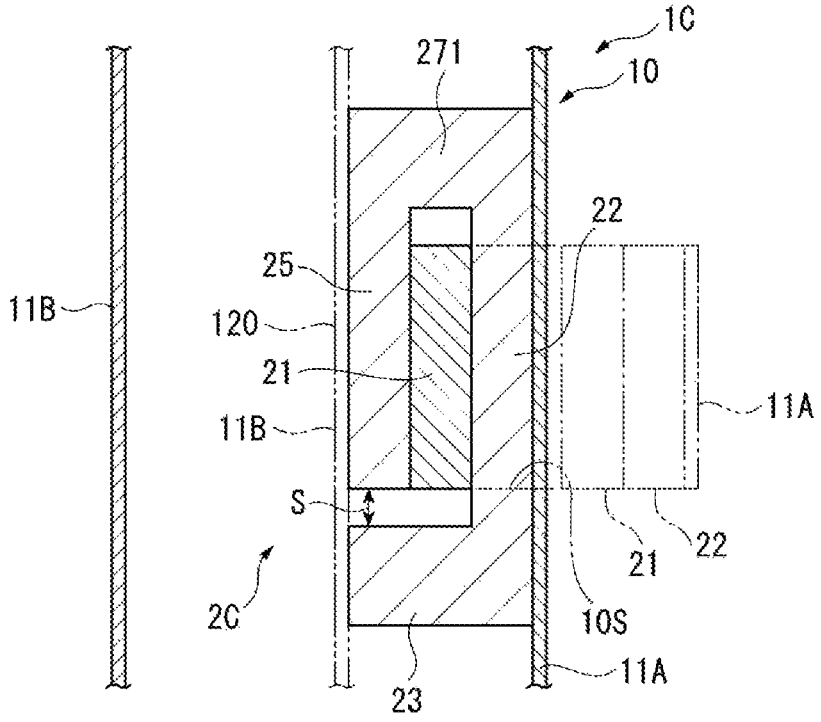
FIG. 7 is a cross sectional view of a relevant part of a bag in a third exemplary embodiment of the invention.

A third exemplary embodiment of the invention will be described with reference to FIG. 7. FIG. 7 is an illustration corresponding to FIG. 6 of the second exemplary embodiment.

The third exemplary embodiment is different from the second exemplary embodiment in that the base 22 and the block 25 are integrated with each other in a tape 2C. In other words, the third exemplary embodiment is the same as the second exemplary embodiment except for the tape 2C different from the tape 2B of the second exemplary embodiment.

It should be noted that the films 11A and 11B are the same as those in the second exemplary embodiment although the films 11A and 11B in FIG. 7 are illustrated thinner than those in FIG. 2 in thickness.

In FIG. 7, a bag 1C of the third exemplary embodiment includes: the films 11A and 11B forming the bag body 10; and the tape 2C.

The tape 2C includes the base 22, the protrusion 23, the tearing guide piece 21, the block 25, and a convex portion 271 integrated with the block 25. The convex portion 271 is formed integrally with a widthwise end of the base 22 unlike the convex portion 26 of the second exemplary embodiment which is bonded to the film 11A.

The convex portion 271 is disposed across the tearing guide piece 21 from the protrusion 23. The base 22, the convex portion 271, and the block 25 as a whole form a U-shaped cross section (a reversed U-shaped cross section in FIG. 7).

A material of the block 25 and the convex portion 271 is the same as the material of the base 22 and the protrusion 23.

The space S is defined between the block 25, the tearing guide piece 21 and the protrusion 23.

The base 22 is provided to the film 11A that is to be torn by the tearing guide piece 21 when opening the bag body 10. The block 25 is provided to the film 11B that is not to be torn by the tearing guide piece 21 when opening the bag body 10. When the base 22 and the film 11A are torn by the tearing guide piece 21 for opening (see a chain double-dashed line in FIG. 7), the base 22 and the film 11A after being torn by the tearing guide piece 21 define the opening 10S of the bag 1C along the tearing guide piece 21.

In FIG. 7, a position of the film 11B at each of the bonding portions 120 (see FIG. 1) is shown by a chain double-dashed line and a position of the film 11B between the bonding portions 120 is shown by a solid line. The block 25 and the protrusion 23 are bonded to the film 11B at the bonding portions 120 while the block 25 and the protrusion 23 are spaced from the film 11B at a position except for the bonding portions 120.

A manufacturing method of the bag 1C in the third exemplary embodiment is the same as that in the second exemplary embodiment.

The third exemplary embodiment can produce the same advantages as the advantages (1) to (7) of the first exemplary embodiment and the the advantages (9) and (10) of the second exemplary embodiment.

Fourth Exemplary Embodiment

Figure 8:
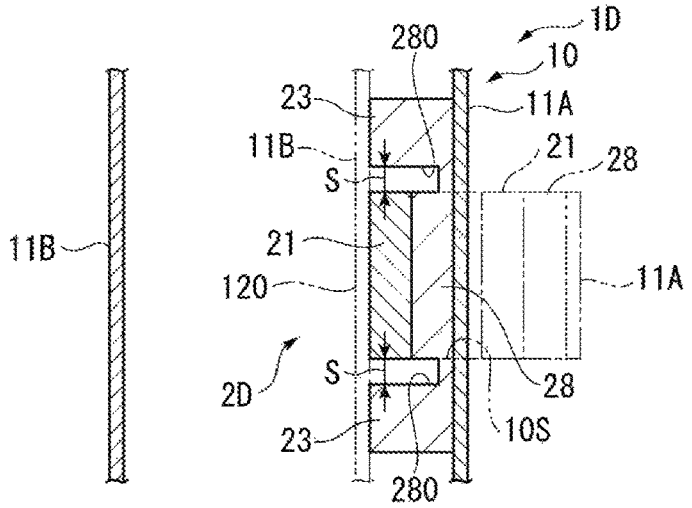
FIG. 8 is a cross sectional view of a relevant part of a bag body in a fourth exemplary embodiment of the invention.

A fourth exemplary embodiment of the invention will be described with reference to FIG. 8. FIG. 8 is an illustration corresponding to FIG. 6 of the second exemplary embodiment.

In the fourth exemplary embodiment, a base 28 of a tape 2D is obtained by forming notches 280 on the base 22 of the first exemplary embodiment. The fourth exemplary embodiment is the same as the first exemplary embodiment except for the above arrangement.

In FIG. 8, a bag 1D of the fourth exemplary embodiment includes: the films 11A and 11B forming the bag body 10; and the tape 2D.

The tape 2D includes the base 28, the tearing guide piece 21 bonded to the base 28, and the protrusions 23 integrated with the base 28. The base 28 is different in shape from the base 22 of the first exemplary embodiment.

Portions of the base 28 corresponding to spaces between the protrusions 23 and the tearing guide piece 21 are thinned. In other words, the space S is defined between each of the protrusions 23 and the tearing guide piece 21, and the base 28 is formed with each notch 280 continuous to the space S. The base 28 is formed such that a thickness of the base 28 at portions where the notches 280 are formed (i.e., a distance between a bottom of each notch 280 and a surface of the base 28 bonded to the film 11A) is thinner than a thickness of the base 28 at a portion where the tearing guide piece 21 is bonded. When the base 28 is torn by the tearing guide piece 21 for opening (see a chain double-dashed line in FIG. 8), the base 28 and the film 11A after being torn by the tearing guide piece 21 define the opening 10S of the bag 1D along the tearing guide piece 21.

A manufacturing method of the bag 1D in the fourth exemplary embodiment is the same as that in the first exemplary embodiment.

The fourth exemplary embodiment can produce the following advantage in addition to the same advantages as the advantages (1) to (8) of the first exemplary embodiment.

(15) Portions of the base 28 corresponding to the spaces between the protrusions 23 and the tearing guide piece 21 are thinned. Accordingly, since the thinned portions of the base 28 are torn by the tearing guide piece 21, only a small force is required for tearing the bag.

Fifth Exemplary Embodiment

Figure 9:
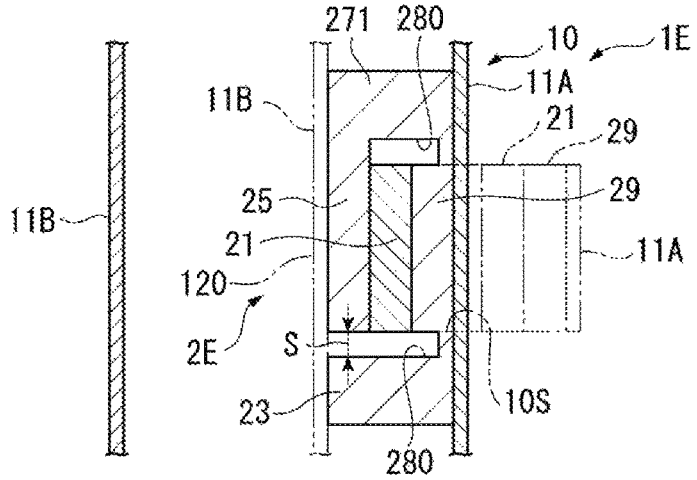
FIG. 9 is a cross sectional view of a relevant part of a bag in a fifth exemplary embodiment of the invention.

A fifth exemplary embodiment of the invention will be described with reference to FIG. 9. FIG. 9 is an illustration corresponding to FIG. 6 of the second exemplary embodiment.

In the fifth exemplary embodiment, a base 29 of a tape 2E is obtained by forming the notches 280 on the base 22 of the third exemplary embodiment. The fifth exemplary embodiment is the same as the third exemplary embodiment except for the above arrangement.

In FIG. 9, a bag 1E of the fifth exemplary embodiment includes: the films 11A and 11B forming the bag body 10; and the tape 2E.

The tape 2E includes the base 29, the tearing guide piece 21 bonded to the base 29, the convex portion 271 integrated with the base 29, and the block formed with the convex portion 271.

The base 29 is different from the base 22 of the third exemplary embodiment in that the notch 280 is formed on a portion of the base 29 corresponding to the space S while the notch 280 is also formed on a portion of the base 29 corresponding to a space between the convex portion 271 and the tearing guide piece 21. The rest of the base 29 is the same as the base 22 of the third exemplary embodiment.

When the base 29 is torn by the tearing guide piece 21 for opening (see a chain double-dashed line in FIG. 9), the base 29 and the film 11A after being torn by the tearing guide piece 21 define the opening 10S of the bag 1E along the tearing guide piece 21.

A manufacturing method of the bag 1E in the fifth exemplary embodiment is the same as that in the third exemplary embodiment.

The fifth exemplary embodiment can produce the same advantages as the advantages (1) to (7) of the first exemplary embodiment, the the advantages (9) and (10) of the second exemplary embodiment, and the advantage (15) of the fourth exemplary embodiment.

Sixth Exemplary Embodiment

Figure 10:
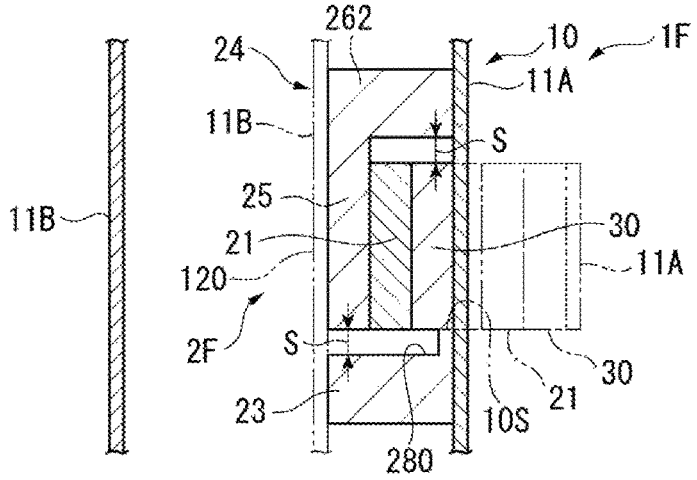
FIG. 10 is a cross sectional view of a relevant part of a bag in a sixth exemplary embodiment of the invention.

A sixth exemplary embodiment of the invention will be described with reference to FIG. 10. FIG. 10 is an illustration corresponding to FIG. 6 of the second exemplary embodiment.

In the sixth exemplary embodiment, a base 30 of a tape 2F is obtained by forming the notches 280 on the base 22 of the second exemplary embodiment. The sixth exemplary embodiment is the same as the second exemplary embodiment except for the above arrangement.

In FIG. 10, a bag 1F of the sixth exemplary embodiment includes: the films 11A and 11B forming the bag body 10; and the tape 2F.

The tape 2F includes: the base 30; the tearing guide piece 21 bonded to the base 30; and the block 25 and the convex portion 26 that are disposed across the tearing guide piece 21 from the the base 30.

The base 30 and the block 25 are provided along the longitudinal direction of the tearing guide piece 21 with the tearing guide piece 21 interposed therebetween.

The base 30 is provided to the film 11A that is to be torn by the tearing guide piece 21 when opening the bag body 10.

The base 30 has the notch 280 at a part corresponding to the space S. The rest of the base 30 is the same as the base 22 of the second exemplary embodiment.

When the base 30 is torn by the tearing guide piece 21 for opening (see a chain double-dashed line in FIG. 10), the base 30 and the film 11A after being torn by the tearing guide piece 21 define the opening 10S of the bag 1F along the tearing guide piece 21.

A manufacturing method of the bag 1F in the sixth exemplary embodiment is the same as that in the second exemplary embodiment.

The sixth exemplary embodiment can produce the same advantages as the advantages (1) to (7) of the first exemplary embodiment, the the advantages (9) and (14) of the second exemplary embodiment, and the advantage (15) of the fourth exemplary embodiment.

Seventh Exemplary Embodiment

A seventh exemplary embodiment of the invention will be described with reference to FIGS. 11 and 12.

The seventh exemplary embodiment is different in an easy opening structure as described below from the second exemplary embodiment. The seventh exemplary embodiment is the same as the second exemplary embodiment except for the easy opening structure.

Figure 11:
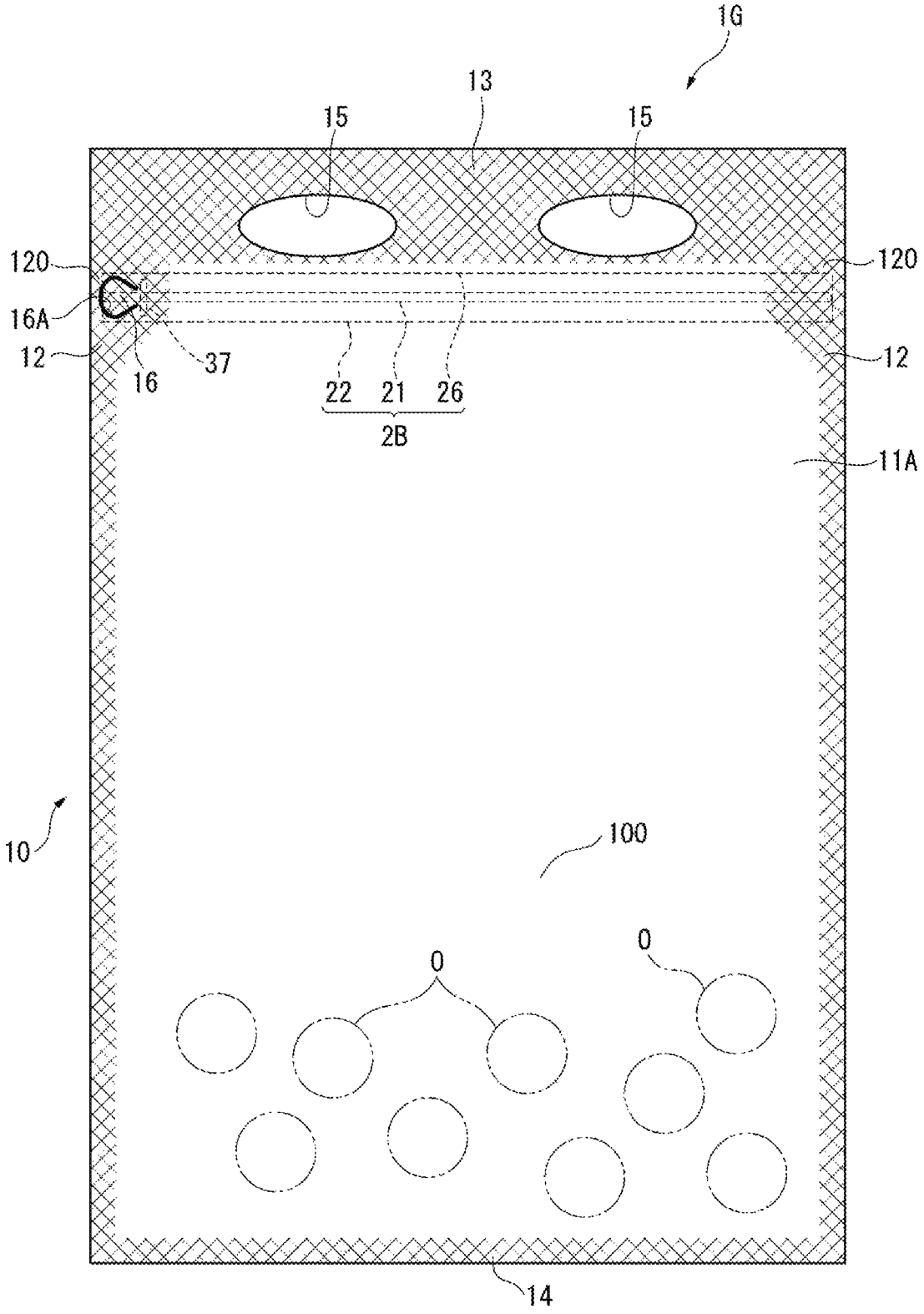
FIG. 11 is a front elevational view of a bag in a seventh exemplary embodiment of the invention.

In FIG. 11 showing an overall structure, a bag 1G of the seventh exemplary embodiment includes: the films 11A and 11B forming the bag body 10 (only the film 11A is shown in FIG. 11); and the tape 2B.

One (on the left in FIG. 11) of the bonding portions 120 provided on the right and left shown in FIG. 11 is provided with the unsealing tab 16 and a weakened line 37, which serves as an easy opening structure, adjacent to the unsealing tab 16 in a direction where the bag body 10 is torn from the unsealing tab 16 to be opened.

Figure 12:
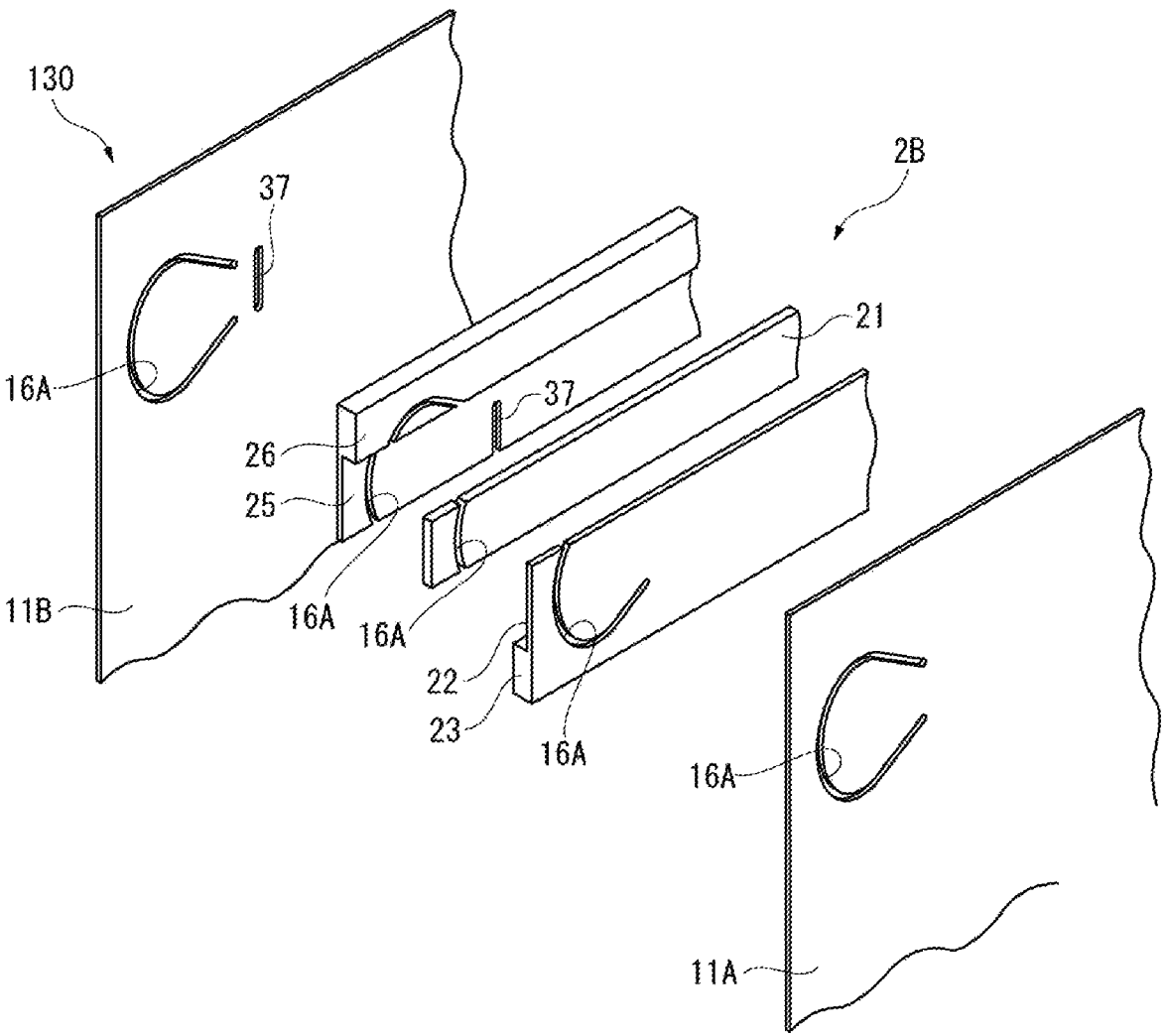
FIG. 12 is an exploded perspective view of a relevant part of the bag body in the seventh exemplary embodiment.

FIG. 12 shows a specific arrangement of the weakened line 37.

As shown in FIG. 12, the weakened line 37 is disposed in a manner to cross the tearing guide piece 21 in a plan view of the film 11B. Although the weakened line 37 is formed separately from the cut portion 16A in FIG. 12, the weakened line 37 may be formed continuously to the cut portion 16A.

The cut portion 16A penetrates the film 11A, base 22, protrusion 23, tearing guide piece 21, block 25, convex portion 26 and film 11B. The weakened line 37 is formed on members that are not to be torn by the tearing guide piece 21, specifically, on the block 25 and the film 11B.

Alternatively, the weakened line 37 is replaced by a circular hole in other examples of the exemplary embodiment. The hole is formed continuously to the cut portion 16A. A shape of an individual hole is not necessarily circular but may be elliptical, rectangular, triangular and the like.

A manufacturing method of the bag 1G in the seventh exemplary embodiment is the same as that in the first exemplary embodiment.

The seventh exemplary embodiment can produce the same advantages as the advantages (1) to (7) of the first exemplary embodiment and the the advantages (9) and (14) of the second exemplary embodiment.

Eighth Exemplary Embodiment

An eighth exemplary embodiment of the invention will be described with reference to FIG. 13.

The eighth exemplary embodiment is different from the first exemplary embodiment in a structure of a bag body 31 and an easy opening structure of the tape 2A, as described below. The eighth exemplary embodiment is the same as the first exemplary embodiment except for the easy opening structure.

Figure 13:
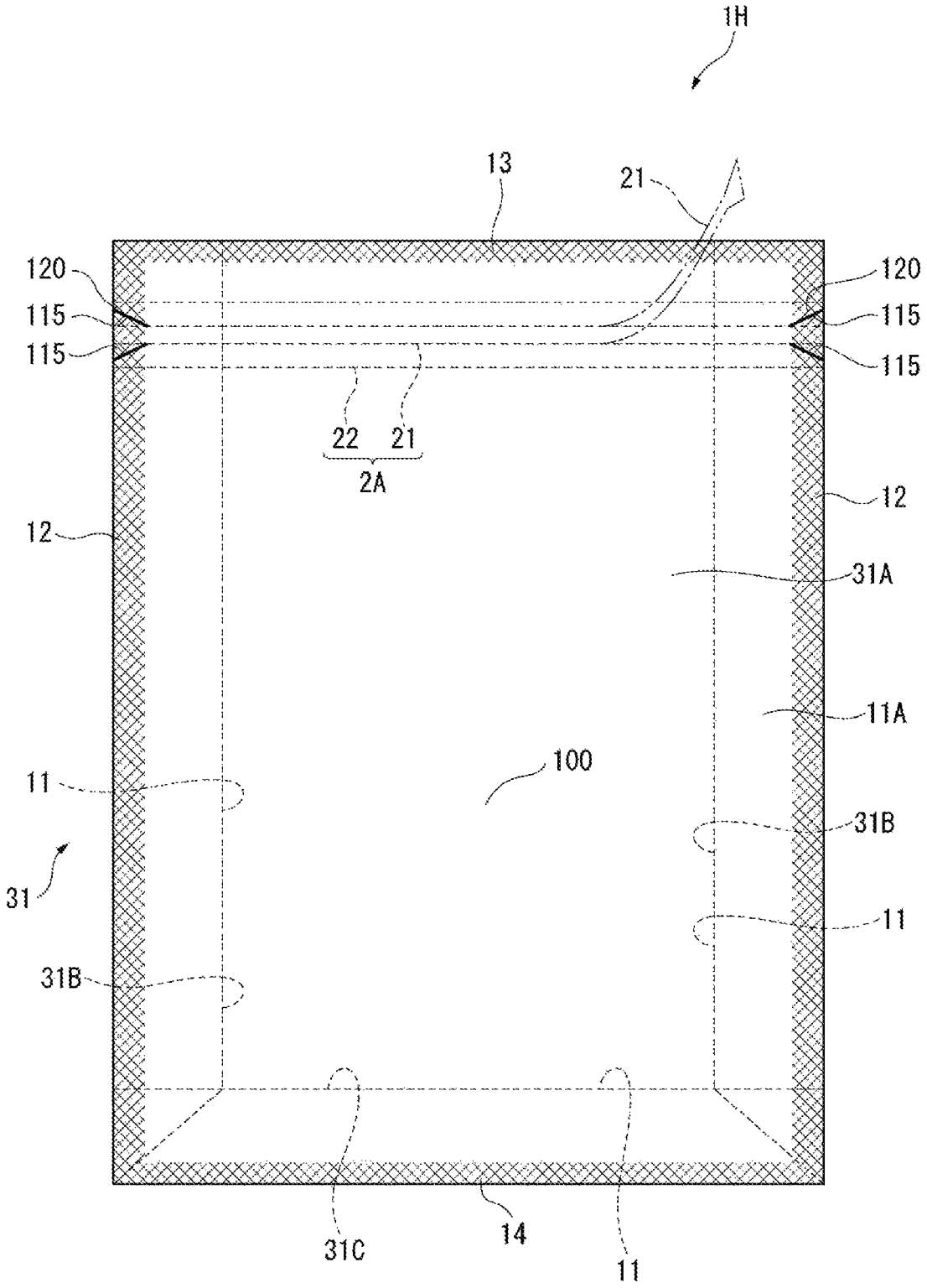
FIG. 13 is a front elevational view of a bag in an eighth exemplary embodiment of the invention.

As shown in FIG. 13, a bag 1H includes the bag body 31 and the tape 2A.

The bag body 31 includes: a pair of flat portions 31A facing each other; a pair of lateral portions 31B intervening between the pair of flat portions 31A at both side edges of the flat portions 31A; and a bottom portion 31C opposite from the top seal portion 13. The bag body 31 is of a gusset type in which the lateral portions 31B and the bottom portion 31C are inwardly folded along folding lines.

The pair of flat portions 31A are formed of the films 11A and 11B (only the film 11A is shown in FIG. 13). The lateral portions 31B and the bottom portion 31C are formed of a film 11 that is the same material as the films 11A and 11B. The films 11, 11A and 11B are sealed at the respective peripheries.

At the side seal portions 12 where both ends of the tape 2A in the longitudinal direction are located, the tape 2A is bonded to an inner surface of one of the pair of flat portions 31A and inner surfaces of the respective lateral portions 31B. An area of the tape 2A stretching between the side seal portions 12 on both sides is bonded to the inner surface of the one of the pair of flat portions 31A.

At each of the bonding portions 120 of the flat portions 31A, two cut portions 115 (i.e., an opening structure) are formed such that the tearing guide piece 21 is interposed therebetween.

When opening the bag, an end of the tearing guide piece 21, which has been able to be pinched by the presence of the cut portions 115, and the film 11A (11B) layered on the tearing guide piece 21 are simultaneously held and, in this state, the tearing guide piece 21 is pulled in a direction separating from the bag 1H, whereby the film 11A is cut to open the bag 1H.

The eighth exemplary embodiment can produce the following advantage in addition to the same advantages as the advantages (1) to (3) and (5) to (8) of the first exemplary embodiment.

(16) Since the bag body 31 including the flat portions 31A, the lateral portions 31B and the bottom portion 31C is of a gusset type, a large receiving portion 100 can be formed by unfolding the inwardly folded lateral portions 31B and bottom portion, whereby a large amount of contents is receivable in the bag.

(17) Since the cut portions 115 (i.e., the opening structure) are formed at each of the bonding portions 120 such that the tearing guide piece 21 is interposed between the cut portions 115, the opening structure itself can be simplified.

It should be understood that the scope of the invention is not limited to the above exemplary embodiments but includes modifications and improvements as long as the modifications and improvements are compatible with the invention.

For instance, although each of the bases 22, 28, 29, 30 and the block 25 is in a form of a single member in the above exemplary embodiments, each of the bases 22, 28, 29, 30 and the block 25 is divided along a width direction of the corresponding tape 2A, 2B, 2C, 2D, 2E, and 2F in some exemplary embodiments.

Further, in some exemplary embodiments, a zipper tape is provided on an inner surface of the bag body 10. For instance, the zipper tape includes: a male belt-shaped base bonded to one of inner surfaces of the bag body 10; a male member having a male portion continuous to the male belt-shaped base; a female belt-shaped base bonded to the other of the inner surfaces of the bag body 10; and a female member continuous to the female belt-shaped base and engageable with the male portion.

In the third exemplary embodiment, the convex portion 271 may be formed as a separate body in place of integrating with the base 22. In this arrangement, the convex portion 271 may be fixed to the base 22 with an adhesive and the like.

Further, the bag body in each of the first to seventh exemplary embodiments may be of a gusset type as in In the eighth exemplary embodiment.

The invention claimed is:

1. A tape bondable to an inner surface of at least one film forming a bag body, the tape comprising:

at least one elongated base;

a tearing guide piece bonded to the base in a longitudinal direction of the base and capable of tearing the base and the at least one film; and at least one protrusion protruding in a direction of the tearing guide piece from a surface of the base to which the tearing guide piece is bonded, the at least one protrusion being formed on a part of the base to which the tearing guide piece is not bonded, wherein at least one elongated block disposed opposite from the base in relation to the tearing guide piece, the at least one elongated block being bondable to the tearing guide piece, and wherein the base and the block are provided along a longitudinal direction of the tearing guide piece with the tearing guide piece interposed therebetween.

2. The tape according to claim 1, further comprising:

at least one convex portion protruding in a direction of the tearing guide piece from a surface of the block that is bondable to the tearing guide piece, the at least one convex portion being formed on a part of the block except for a part of the block that is bondable to the tearing guide piece.

3. The tape according to claim 2, wherein the at least one convex portion and the protrusion are disposed with the tearing guide piece interposed therebetween, and an end of the at least one convex portion in the direction of the tearing guide piece is bondable to the film of the bag body to which the base is bondable.

4. The tape according to claim 2, wherein a bonding strength between the base and the tearing guide piece is larger than a bonding strength between the block and the tearing guide piece.

5. The tape according to claim 4, wherein compatibility between a resin forming the block and a resin forming the tearing guide piece is lower than compatibility between a resin forming the base and the resin forming the tearing guide piece.

6. The tape according to claim 1, wherein the protrusion is in no contact with the tearing guide piece.

7. The tape according to claim 6, wherein a portion of the base corresponding to a space between the protrusion and the tearing guide piece is thinned.

8. A bag comprising:

a bag body made of at least one film; and a tape bonded to an inner surface of the at least one film of the bag body, wherein the tape comprises:

at least one elongated base;

a tearing guide piece bonded to the base in a longitudinal direction of the base and configured to tear the base and the at least one film; and at least one protrusion protruding in a direction of the tearing guide piece from a surface of the base to which the tearing guide piece is bonded, the at least one protrusion being formed on a part of the base to which the tearing guide piece is not bonded, wherein the tape is bonded to the inner surface of the at least one film of the bag body through the at least one base, wherein at least one elongated block disposed opposite from the base in relation to the tearing guide piece, the at least one elongated block being bondable to the tearing guide piece, and wherein the base and the block are provided along a longitudinal direction of the tearing guide piece with the tearing guide piece interposed therebetween.

9. The bag according to claim 8, further comprising:

at least one convex portion protruding in a direction of the tearing guide piece from a surface of the block to which the tearing guide piece is bonded, the at least one convex portion being formed on a part of the block to which the tearing guide piece is not bonded.

10. The bag according to claim 9, wherein the at least one convex portion and the protrusion are disposed with the tearing guide piece interposed therebetween, and an end of the at least one convex portion in the direction of the tearing guide piece is bonded to the film of the bag body to which the base is bonded.

11. The bag according to claim 9, wherein a bonding strength between the base and the tearing guide piece is larger than a bonding strength between the block and the tearing guide piece.

12. The bag according to claim 11, wherein the block and the tearing guide piece are formed of mutually poorly compatible resins, and the base and the tearing guide piece are formed of mutually well-compatible resins.

13. The bag according to claim 8, wherein the protrusion is not in contact with the tearing guide piece.

14. The bag according to claim 13, wherein a portion of the base corresponding to a space between the protrusion and the tearing guide piece is thinned.

15. The bag according to claim 8, wherein the bag body has first and second walls facing each other, the first wall is configured to define an opening by being torn by the tearing guide piece, and a part of the tearing guide piece on the second wall is exposed outside through a hole or a weakened line.

16. The bag according to claim 8, wherein the bag body forms a receiving portion capable of receiving contents therein, and the bag body has a contents-receiving opening defined by edges of the bag body opposite from a portion where the receiving portion is formed, with respect to the tape.

17. The bag according to claim 8, wherein the bag body forms a receiving portion in which contents are received, and the edges of the bag body, which are opposite with respect to the tape from the portion of the bag body where the receiving portion is formed, are bonded.

18. The bag according to claim 8, wherein the bag body is provided with a holding portion at an end thereof.

19. The bag according to claim 8, wherein the bag body comprises: a pair of flat portions facing each other; a pair of lateral portions interposed between the pair of flat portions at both side edges of the bag body; and a bottom portion, the lateral portions and the bottom portion being inwardly folded along folding lines.

* * * * *